United States Patent [19]

Piltz

[11] Patent Number: 4,944,426

[45] Date of Patent: Jul. 31, 1990

[54] CLOSURE DEVICE FOR A PACKAGING CONTAINER

[75] Inventor: Lars-Erik Piltz, Dalby, Sweden

[73] Assignee: AB Akerlund & Rausing, Sweden

[21] Appl. No.: 309,414

[22] Filed: Feb. 10, 1989

[30] Foreign Application Priority Data

Feb. 16, 1988 [SE] Sweden ..... 8800514

[51] Int. Cl.[5] ..... B65D 41/32

[52] U.S. Cl. ..... 220/270

[58] Field of Search ..... 220/270; 215/254

[56] References Cited

U.S. PATENT DOCUMENTS 3,187,931 6/1965 Henchert .

4,565,294 1/1986 Smith ..... 220/270 X 4,702,387 10/1987 Wombold ..... 220/270

FOREIGN PATENT DOCUMENTS 8306089-7 8/1986 Sweden .

1377815 3/1972 United Kingdom .

*Primary Examiner*—Donald F. Norton

*Attorney, Agent, or Firm*—Lerner, David, Littenberg, Krumholz & Mentlik

[57] ABSTRACT

An easy opening arrangement for a closure of a packaging container. The easy opening arrangement has a grip, preferably shaped as a ring, and from said grip there emanates tearing denotations in a removable part of the closure.

Via a first connection portion said grip is connected to said emanating tearing denotations. The arrangement includes at least one further connection portion to the closure part. Said so called further connection portion maintains a substantial portion of the grip at a certain distance from the closure part, such that said substantial portion is easy grippable.

8 Claims, 1 Drawing Sheet

CLOSURE DEVICE FOR A PACKAGING CONTAINER

FIELD OF THE INVENTION

The present invention relates to a device at a closure for a packaging container and more precisely a device at an end closure having a so called easy opening arrangement.

Arrangements of such type may be found at packaging containers of various types, for instance metal cans, cardboard folding boxes, plastic containers, tubes, etc. Of course, the easy opening arrangement is not there for any selfish reasons, instead the consumer—having the absolute right—dictates such facilities. The packaging producer has to consider such a clearly emphasized wish.

BACKGROUND OF THE INVENTION

However, easy opening devices frequently incur more annoyment compared to what is the case at packaging containers without such devices. A serious point of irritation is caused by the fact that the easy opening is difficult to grip. For instance there are various grips which may be gripped merely by a large input of effort and thereafter, hopefully, have a good enough tearing strength for breaking up a tearing denotation. Said two steps, an initial catching of the grip and thereafter the step of holding the grip with a sufficient force, may appear to be steps that could be offered to the consumer by the packaging manufacturer without any difficulties.

However, it has turned out that the prior art grip arrangements do not meet such conditions. The reason for this is of course difficult to find, but presumably the indispensable rational production philosophy of the manufacturer in order to achieve a maximum production rate by using the cheapest possible production facility is one of several factors in this particular case.

OBJECTS OF THE INVENTION

According to the present invention there is no retreat as to simplicity or a rational production but nevertheless, the object of the invention is to solve the problem of gripping a grip forming a part of an easy opening arrangement for a packaging container.

SUMMARY OF THE INVENTION

The present invention provides a device for a closure of a packaging container, where the closure is provided with an easy opening arrangement having a grip and a tearing denotation emanating from the grip and extending in a removable part of the closure, and the grip is connected to said closure part via said emanating tearing denotation.

The device is characterized in that the grip has at least a further connection portion to the closure part, and that said portion maintains a substantial part of the grip at a certain distance from the closure part, such that said substantial portion will be easy grippable.

According to one embodiment of the invention said further connection portion is dimensioned such that it is easy tearable but of a sufficient strength for resisting the forces acting on the grip when pulling cores and/or ejection operations out of the forming tool, when the closure is injection moulded from plastics or a corresponding material.

In one preferable embodiment the grip has the shape of a ring, and said further connection portion comprises at least one narrow material bridge between the ring and the closure part placed at said certain distance from the ring.

A preferable embodiment is such that said material bridge is located radially inwardly from the radially outer circumferential surface of the ring.

The ring preferably is sufficiently large for easily encompassing a finger.

In one embodiment said ring is maintained at said predetermined distance from the closure part by means of a pair of diametrically opposite material bridges.

A straight line through the material bridges forms a generally perpendicular angle relative the connection portion of the ring at the emerging tearing denotation.

Maintaining the requirement for simple tools mentioned at the introduction it has turned out that the arrangement according to the present invention is specifically of advantage when injection moulding by using one single ingot, in which case the package closure has just one ingot place, which preferably may be located at the center of the closure.

The location of the tearing or pulling ring is of course arbitrary, but a preferable embodiment comprises a ring placed at the center.

DESCRIPTION OF PREFERRED EMBODIMENTS

Figure 1:
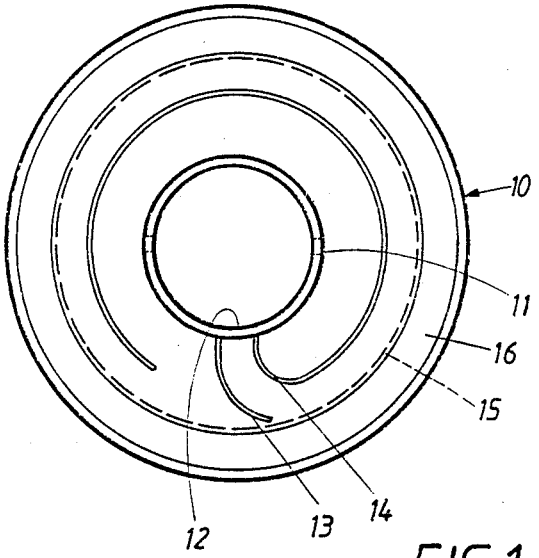
FIG. 1 in a view from above shows a container closure according to one embodiment of the invention.

The closure or container cover identified by the numeral 10 in FIG. 1 is of the so called easy opening type. For such reason there is a grip in the shape of a pulling ring 11 formed on the closure.

Via a first connection portion 12 the ring 11 merges into a tearing denotation comprising a pair of grooves 13, 14 forming reduced material portions, said grooves being shown by solid lines in FIG. 1, because normally there is formed a bead formed "image" of such grooves at the upper side of a closure. The grooves are formed in the lower side of the closure, which appears from the extension of the tearing denotation 13 indicated by the numeral 15.

The reference numeral 16 denotes a circumferential rim intended for attachment to the end of a packaging container or any feasible connection piece of a container.

The tearing denotation 15, thus, will be placed close to the container wall and leaves a generally smooth pouring opening after the closure has been broken through along the denotations 13, 14, 15 by use of the pull ring 11 as a grip for a finger.

Said pull ring 11 is sufficiently large for easily encompassing a finger, for instance the pointing finger. As appears from FIG. 2, the ring 11 is located at a predetermined distance d from the plane 17 for a cover panel of the closure, the center portion thereof in the embodiment shown. As previously mentioned the pull ring has a first connection portion 12 to the tearing denotations 13, 14 formed in the portion 17, and said connection portion 12 is dimensioned such that the indicated distance d may be maintained. Of course, the main task of the connection portion 12 is not to maintain a certain predetermined distance relative the element 17, but said connection portion forms a grip of sufficient strength to the strip 18 of the element 17 formed when breaking through the closure.

However, in order to allow an easy initial grip of the ring 11, it is important to carefully see to it that the distance d really prevails. For this particular reason there is a pair of diametrically opposite, narrow material bridges 19, 20 which connect the ring 11 to the element 17 and positively define the said distance d in the embodiment shown. However, the strength of said material bridges 19, 20 is such that the ring will be easily separable from the support at the region for the bridges 19, 20, by placing a finger in the ring and pulling it upwards.

In order to produce a closure of the type shown by using a rational technique, the present invention has disclosed that it is necessary to rely on a plastics injection moulding technique. According to the invention it has turned out to be possible to use for instance polyprophylene or another thermoplastics material, especially within the polyolefine group.

Figure 2:
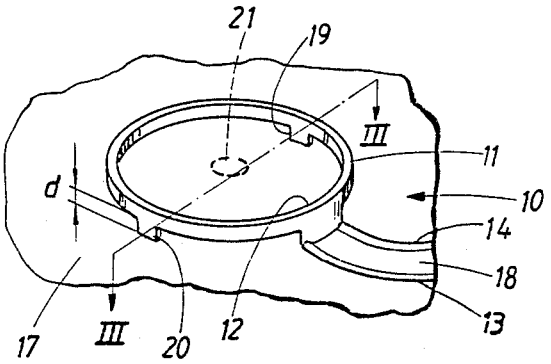
FIG. 2 is a partial perspective view of the grip forming part of an easy opening arrangement.

In order to make use of a really favourable injection moulding technique, it is of great advantage to have just one single ingot. Thus, FIG. 2 shows one ingot place 21, in the actual embodiment placed at the center of the closure 10.

Figure 3:
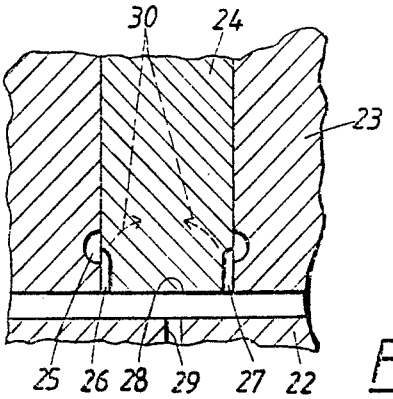
FIG. 3 is a partial section view of an injection moulding tool for manufacturing of the closure of plastics or a corresponding material.

However, in order to be able to produce the ring having the two opposite material bridges 19, 20 in FIG. 1 by using such an arrangement, the present invention discloses a specific preferable placement of such bridges 19, 20. In FIG. 3 in a partial section in a simplified representation, there is shown a portion of an injection moulding tool for manufacturing of closures 10. The tool comprises a female element 11 and a male element 23 and a core 24. The elements 23 and 22 are vertically movable relative each other, and the element 24 is vertically ejectable.

The numeral 25 indicates the placement of a circumferential groove in the male element 24 for forming the ring 11. Radially inwardly from the outer surface of the circumferential groove 25 there are a pair of axially or vertically extending, groove shaped cut outs 26, 27 in the end of the core 24 extending the whole way up to the end surface 28. In FIG. 3 there is, additionally, shown a centrally placed ingot 29. By using the arrangement according to FIG. 3 there will be no difficulties to make the core ejection after the injection moulding, i.e. the removal of the core 24 vertically upwards. It has also turned out that the relative placement, radially inwardly relative the ring 21 of the material bridges 19, 20 obtained by means of the grooves 26, 27 allows a fast and safe ejection from the mould of the injection moulded closure moulded in one step. Due to the radially inwards displaced placement of the material bridges 19, 20, such bridges will easily fold inwards in the direction of the arrows 20, as soon as a relative movement between the tool parts 22, 23 is initiated.

However, it is of importance that the wall thickness of the grooves 26, 27 and the bridges 19, 20, respectively, is dimensioned such that the ejection deformation does not break up the material bridges. However, at the same time it is necessary to realize that said material bridges, as mentioned at the introduction, are not allowed to be too strong but easy breakable by means of said finger grip.

We claim:

1. An irreversibly openable closure for a packaging container comprising a substantially planner member containing an easy opening arrangement including a grip and a tearing strip defined by at least one tearing denotation emanating from said grip, said grip being integrally molded with said tearing strip and said grip having at least one additional connection portion attached to said closure, said connection portion of said grip having a predetermined size and shape adapted to maintain a substantially portion of said grip at a certain distance from said closure such that said grip is easily gripable, and wherein the operation of said grip is substantially normal to said substantially planner member.

2. The closure according to claim 1, wherein said predetermined size and shape of said connection portion provides both easy tearability and sufficient strength for resisting forces acting on said grip during moulding.

3. The closure according to claim 2, wherein said grip has a shape of a ring having inner and outer circumferential surfaces, and connection portion comprises at least one narrow bridge of injection molded material between said ring and said substantially planner member.

4. The closure according to claim 3, wherein said at least one narrow bridge is disposed radially inwardly from said outer circumferential surface of said ring.

5. The closure according to claim 4, wherein said ring is of a size and shape adapted to encompass a finger.

6. The closure according to claim 5, wherein said connection portion comprises a plurality of diametrically opposed narrow bridges.

7. The closure according to claim 15, wherein said plurality of diametrically opposed narrow bridges are disposed equi-distant from said tearing strip.

8. The closure according to claim 7, wherein said ring is placed generally centrally at the closure.

* * * * *

UNITED STATES PATENT AND TRADEMARK OFFICE

CERTIFICATE OF CORRECTION

PATENT NO. : 4,944,426

DATED : July 31, 1990

INVENTOR(S) : Lars-Erik Piltz

It is certified that error appears in the above-identified patent and that said Letters Patent is hereby corrected as shown below:

Column 4, Line 36, after "surfaces, and" insert --said--.

Column 4, Line 48, "claim 15" should read --claim 6--.

Signed and Sealed this

Twenty-fourth Day of September, 1991

*Attest:*

HARRY F. MANBECK, JR.

*Attesting Officer*

*Commissioner of Patents and Trademarks*